US012072174B2

(12) United States Patent
Rastegar

(10) Patent No.: US 12,072,174 B2
(45) Date of Patent: Aug. 27, 2024

(54) SHEAR-PIN BASED INERTIA IGNITERS WITH PRESET NO-FIRE PROTECTION FOR MUNITIONS AND THE LIKE

(71) Applicant: Omnitek Partners LLC, Ronkonkoma, NY (US)

(72) Inventor: Jahangir S Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 18/102,740

(22) Filed: Jan. 29, 2023

(65) Prior Publication Data

US 2023/0175825 A1 Jun. 8, 2023

Related U.S. Application Data

(60) Division of application No. 16/664,432, filed on Oct. 25, 2019, now Pat. No. 11,578,960, which is a continuation of application No. 15/934,973, filed on Mar. 24, 2018, now Pat. No. 10,458,769.

(60) Provisional application No. 62/476,839, filed on Mar. 26, 2017.

(51) Int. Cl.

| | |
|---|---|
| ***F42C 15/24*** | (2006.01) |
| ***F42C 1/04*** | (2006.01) |
| ***F42C 19/08*** | (2006.01) |

(52) U.S. Cl.

CPC ..... *F42C 15/24* (2013.01); *F42C 1/04* (2013.01); *F42C 19/0838* (2013.01)

(58) Field of Classification Search

CPC .. F42C 15/00; F42C 15/24; F42C 1/04; F42C 19/08; F42C 19/0838

USPC ..... 102/216, 247, 251, 252, 253, 256

See application file for complete search history.

(56) References Cited

U.S. PATENT DOCUMENTS

| | | | | |
|---|---|---|---|---|
| 3,425,351 | A * | 2/1969 | Clayton | F42C 1/04 102/253 |
| 7,437,995 | B2 * | 10/2008 | Rastegar | C06C 9/00 102/253 |
| 7,832,335 | B2 * | 11/2010 | Rastegar | F42C 15/34 102/253 |
| 8,191,476 | B2 * | 6/2012 | Rastegar | F42C 11/008 102/254 |
| 10,458,769 | B2 * | 10/2019 | Rastegar | F42C 19/0838 |
| 11,578,960 | B2 * | 2/2023 | Rastegar | F42C 19/0838 |

* cited by examiner

*Primary Examiner* — James S Bergin

(57) ABSTRACT

An inertial igniter for igniting a thermal battery, including: a base having a first projection; a striker mass rotatably connected to the base having a second projection, when the striker mass is rotated towards the base, the first projection impacts the second projection; a member having a first portion engaging with a second portion of the striker mass to restrict rotation of the striker mass unless a predetermined acceleration is experienced; a mass movable from a first position where an acceleration is less than the predetermined acceleration and a second position where the acceleration is greater than the predetermined acceleration to permit the first and second portions to come out of engagement; a spring for biasing the mass in the first position; and a rotation prevention member for permitting impact of the first and second projections when the predetermined acceleration is experienced and the mass moves to the second position.

12 Claims, 10 Drawing Sheets

SHEAR-PIN BASED INERTIA IGNITERS WITH PRESET NO-FIRE PROTECTION FOR MUNITIONS AND THE LIKE

CROSS-REFERENCE TO RELATED APPLICATIONS

This application is a Divisional Application is U.S. application Ser. No. 16/664,432, filed on Oct. 25, 2019, which is a Continuation Application of U.S. application Ser. No. 15/934,973, filed on Mar. 24, 2018, which claims the benefit of U.S. Provisional Application No. 62/476,839, filed on Mar. 26, 2017, the entire contents of each of which are incorporated herein by reference.

BACKGROUND

1. Field of the Invention

The present disclosure relates generally to mechanical igniters, and more particularly to compact, reliable and easy to manufacture mechanical igniters for reserve batteries such as thermal batteries and the like constructed with shear-pins with preset no-fire protection that are activated by shock loadings such as by gun firing setback acceleration.

2. Prior Art

Reserve batteries of the electrochemical type are well known in the art for a variety of uses where storage time before use is extremely long. Reserve batteries are in use in applications such as batteries for gun-fired munitions including guided and smart, mortars, fusing mines, missiles, and many other military and commercial applications. The electrochemical reserve-type batteries can in general be divided into two different basic types.

The first type includes the so-called thermal batteries, which are to operate at high temperatures. Unlike liquid reserve batteries, in thermal batteries the electrolyte is already in the cells and therefore does not require a release and distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape.

The second type includes the so-called liquid reserve batteries in which the electrodes are fully assembled for cooperation, but the liquid electrolyte is held in reserve in a separate container until the batteries are desired to be activated. In these types of batteries, by keeping the electrolyte separated from the battery cell, the shelf life of the batteries is essentially unlimited. The battery is activated by transferring the electrolyte from its container to the battery electrode compartment (hereinafter referred to as the "battery cell").

A typical liquid reserve battery is kept inert during storage by keeping the aqueous electrolyte separate in a glass or metal ampoule or in a separate compartment inside the battery case. The electrolyte compartment may also be separated from the electrode compartment by a membrane or the like. Prior to use, the battery is activated by breaking the ampoule or puncturing the membrane allowing the electrolyte to flood the electrodes. The breaking of the ampoule or the puncturing of the membrane is achieved either mechanically using certain mechanisms usually activated by the firing setback acceleration or by the initiation of certain pyrotechnic material. In these batteries, the projectile spin or a wicking action is generally used to transport the electrolyte into the battery cells.

Reserve batteries are inactive and inert when manufactured and become active and begin to produce power only when they are activated. Reserve batteries have the advantage of very long shelf life of up to 20 years that is required for munitions applications.

Thermal batteries generally use some type of initiation device (igniter) to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters," operate based on the firing acceleration. The inertial igniters do not require onboard batteries for their operation and are thereby often used in munitions applications such as in gun-fired munitions and mortars.

Inertial igniters are also used to activate liquid reserve batteries through the rupture of the electrolyte storage container or membrane separating it from the battery core. The inertial igniter mechanisms may also be used to directly rupture the said electrolyte storage container or membrane.

Inertial igniters used in munitions must be capable of activating only when subjected to the prescribed setback acceleration levels and not when subjected to all so-called no-fire conditions such as accidental drops or transportation vibration or the like. This means that safety in terms of prevention of accidental ignition is one of the main concerns in inertial igniters.

In recent years, new improved chemistries and manufacturing processes have been developed that promise the development of lower cost and higher performance thermal and liquid reserve batteries that could be produced in various shapes and sizes, including their small and miniaturized versions. However, the existing inertial igniters are relatively large and not suitable for small reserve batteries, particularly those that are being developed for use in miniaturized fuzing, future smart munitions, and other similar applications. This is particularly the case for reserve batteries used in gun-fired munitions that are subjected to high G setback accelerations, sometimes 10,000-30,000 G and higher.

Inertia-based igniters must provide two basic functions. The first function is to provide the capability to differentiate the aforementioned accidental events such as drops over hard surfaces or transportation vibration or the like, i.e., all no-fire events, from the prescribed firing setback acceleration (all-fire) event. In inertial igniters, this function is performed by keeping the device striker fixed to the device structure during all aforementioned no-fire events until the prescribed firing setback acceleration event is detected. At which time, the device striker is released. The second function of an inertia-based igniter is to provide the means of accelerating the device striker to the kinetic energy that is needed to initiate the device pyrotechnic material as it (hammer element) strikes an "anvil" over which the pyrotechnic material is provided. In general, the striker is provided with a relatively sharp point which strikes the pyrotechnic material covering a raised surface over the anvil, thereby allowing a relatively thin pyrotechnic layer to be pinched to achieve a reliable ignition mechanism. In many applications, percussion primers are directly mounted on the anvil side of the device and the required initiation pin is machined or attached to the striker to impact and initiate the primer. In either design, exit holes are provided on the inertial igniter to allow the reserve battery activating flames and sparks to exit.

Two basic methods are currently available for accelerating the device striker to the aforementioned needed velocity (kinetic energy) level. The first method is based on allowing the setback acceleration to accelerate the striker mass following its release. This method requires the setback acceleration to have long enough duration to allow for the time that it takes for the striker mass to be released and for the striker mass be accelerated to the required velocity before pyrotechnic impact. As a result, this method is applicable to larger caliber and mortar munitions in which the setback acceleration duration is relatively long and in the order of several milliseconds, sometimes even longer than 10-15 milliseconds. This method is also suitable for impact induced initiations in which the impact induced decelerations have relatively long duration.

The second method relies on potential energy stored in a spring (elastic) element, which is then released upon the detection of the prescribed all-fire conditions. This method is suitable for use in munitions that are subjected to very short setback accelerations, such as those of the order of 1-2 milliseconds. This method is also suitable for impact induced initiations in which the impact induced decelerations could have relatively short durations.

Inertia-based igniters must therefore comprise two components so that together they provide the aforementioned mechanical safety, the capability to differentiate the prescribed all-fire condition from all aforementioned no-fire conditions and to provide the required striking action to achieve ignition of the pyrotechnic elements. The function of the safety system is to keep the striker element in a relatively fixed position until the prescribed all-fire condition (or the prescribed impact induced deceleration event) is detected, at which time the striker element is to be released, allowing it to accelerate toward its target under the influence of the remaining portion of the setback acceleration. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

A schematic of a cross-section of a conventional thermal battery and inertial igniter assembly is shown in FIG. 1. In thermal battery applications, the inertial igniter 10 (as assembled in a housing) is generally positioned above (in the direction of the acceleration) the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total space that the thermal battery assembly 16 occupies within a munitions housing (usually determined by the total height 15 of the thermal battery), it is therefore important to reduce the height of the inertial igniter 10. This is particularly important for small thermal batteries since in such cases and with currently available inertial igniter, the height of the inertial igniter portion 13 is a significant portion of the thermal battery height 15.

The schematics of FIGS. 2 and 3 presents inertial igniters disclosed in U.S. Pat. No. 8,931,413, issued Jan. 13, 2015, the contents of which is incorporated herein by reference). The significant shortcomings of the prior art inertial igniters are clearly shown which limits their use to munitions with high setback acceleration levels and in which the setback acceleration level is required to be sometimes 5-10 times or more the maximum no-fire acceleration levels to achieve the required level of safety (unwanted and accidental ignition) and the very high reliability levels (sometimes above 99.9 percent reliability at 95 percent confidence level).

The schematic of a cross-sectional view of a prior art embodiment 20 is shown in FIG. 2. The inertial igniter 20 is usually cylindrical in shape since most thermal batteries are constructed in cylindrical shapes. The inertial igniter 20 consists of a base element 21, which in a thermal battery construction shown in FIG. 1 would be positioned in the housing 10 with the base element 21 positioned on the top of the thermal battery cap 19. A striker mass 22 of the inertial igniter is attached to the base element 21 via a rotary joint 23. In the embodiment 20 of FIG. 2, the striker mass 22 is kept separated from the base element 21 by a spring element 24, which biases the striker mass 22 away from the base element 21. A stop element 25 is also provided to limit the counterclockwise rotation of the striker mass 22 relative to the base element 21. The stop element 25 is attached a post 26, which is in turn attached to the base element 21 of the inertial igniter 20.

The spring element 24 can be preloaded in compression such that with the no-fire acceleration acting on the base element 21 of the inertial igniter in the upward direction, as shown by the arrow 27, the inertia force due to the mass of the striker mass 22 would not overcome (or at most be equal to) the preloading force of the spring element 24. As a result, the inertial igniter 20 is ensured to satisfy its prescribed no-fire requirement.

A shearing pin 28 is also provided and is fixed to the post 26 on one end and to a portion, such as an end of the striker mass 21 on the other end, as shown in FIG. 2. The shearing pin 28 is provided with a narrow neck 29, which provides for concentrated stress when the striker mass 22 is pressed down towards the base element 21 due to all-fire acceleration in the direction of the arrow 27 acting on the inertia of the striker mass 22. By properly designing the geometry of the shearing pin 28 and its neck 29 and selection of the proper material for the shearing pin 28, the shearing pin 28 can be designed to fracture in shear (or in any other mode), thereby releasing the striker mass 22 and allowing it to be accelerated in the clockwise rotation. By selecting a proper mass and moment of inertial for the striker mass 22 and the required range of clockwise rotation for the striker mass 22, it would gain enough kinetic energy to initiate the pyrotechnic material 30 between the pinching points provided by the protrusions 31 and 32 on the base element 21 and the bottom surface of the striker mass 22, respectively. The ignition flame and sparks can then travel down through the opening 33 provided in the base element 21. When assembled in a thermal battery similar to the thermal battery 16 of FIG. 1, the inertial igniter is mounted in the housing 10 such that the opening 33 is lined up with the opening 12 into the thermal battery 11 to activate the battery by igniting its heat pallets.

It will be appreciated by those skilled in the art that the duration of the all-fire acceleration level is also important for the proper operation of the inertial igniter 20 by ensuring that the all-fire acceleration level is available long enough to accelerate the striker mass 22 towards the base element 21 to gain enough energy to initiate the pyrotechnic material 30 as described above by the pinching action between the protruding elements 31 and 32.

It is also appreciated by those skilled in the art that when the inertial igniter 20 (FIG. 2) is assembled inside the housing 10 of the thermal battery assembly 16 of FIG. 1, a cap 18 (or a separate internal cap—not shown) is commonly used to secure the inertial igniter 20 inside the housing 10. In such assemblies, the stop element 25 is no longer functionally necessary since the striker mass 22 is prevented by said cap from tending to rotate in the counterclockwise direction by the spring element 24. By providing the stop element 25, the storage of the inertial igniter 20 and the process of assembling it into the housing 10 is significantly simplified since one does not have to provide secondary means to keep the spring element 24 from applying shearing load to the shearing pin 28.

It is to be noted that in place of the shearing pin 28, other types of elements that are designed to fracture upon the application of the all-fire acceleration as described above and release the striker mass 22 may be used to perform the same function. For example, the mode of fracture may be selected to be in tension, torsion or pure bending. In general, the fracture is desired to be achieved with minimal deformation in the direction that results in a significant clockwise rotation of the striker mass 22 prior to pin fracture and release of the striker mass 22. This would result in minimum height for the inertial igniter since the clockwise rotation of the striker mass 22 will reduce the terminal (clockwise) rotational speed of the striker mass 22 at the instant of initiation impact between the protruding elements 31 and 32, FIG. 2, and pinching of the pyrotechnic material 30 to achieve initiation.

As an example of the prior art, the shearing pin 28, FIG. 2, has been replaced with a pin that is designed to fracture in tension when the inertial igniter 20 is subjected to the aforementioned all-fire acceleration as shown in the schematic of FIG. 3. Part of the base element 40, the post 41, the stop element 42 and the front portion of the striker mass 43 (indicated by numerals 21, 26, 25 and 22 in FIG. 2, respectively) are shown in the schematic of FIG. 3. The stop element 42 is provided with a hole and countersink 44 as shown in FIG. 3. An opposite hole and countersink 45 is provided in the striker mass 43 under the stop element 42 as shown in FIG. 3. A one-piece tension element 46 (which can be cylindrical in shape) with top and bottom flange portions 47 and 48, respectively, is also provided. The top flange portion 47 of the tension element 46 is assembled seating in the countersink 44 of the stop element 42 and the bottom flange portion 48 of the tension element 46 is assembled seating in the countersink 45 of the striker mass 43. The stop element 42 and the striker mass 43 can be provided with passages (not shown) for assembling the tension element 46 as shown in FIG. 3. Alternatively, the tension element 46 may be a two-part element that is assembled in place as shown in FIG. 3, such as by riveting, welding or otherwise fastening the flange 47 to the stem portion of the tension element 46. The tension element 46 is also provided with a narrow neck portion 49, which provides for concentrated stress when the striker mass 43 is pressed down towards the base element 40 due to all-fire acceleration in the direction of the arrow 27 (FIG. 2) acting on the inertia of the striker mass 43.

By properly designing the geometry of the tension element 46 and its neck portion 49 and selection of the proper material, the tension element 46 can be designed to fracture in tension, thereby releasing the striker mass 43 and allowing it to be accelerated in the clockwise rotation. As a result, for a properly designed inertial igniter, i.e., by selecting a proper mass and moment of inertial for the striker mass 43; providing the required range of clockwise rotation for the striker mass 43 so that it would gain enough energy as it impacts the pyrotechnic material of the inertial igniter, FIG. 2; and by considering the all-fire acceleration level and its duration and the preloading level of the spring element 24, the striker mass 43 will gain enough energy to initiate the pyrotechnic material 30 between the pinching points provided by the protrusions 31 and 32 on the base element 40 and the bottom surface of the striker mass 43, respectively, as shown in the schematics of FIG. 2. The ignition flame and sparks will then travel down through the opening 33 provided in the base element 40, FIG. 2. When assembled in a thermal battery similar to the thermal battery 16 of FIG. 1, the inertial igniter is mounted in the housing 10 such that the opening 33 is lined up with the opening 12 into the thermal battery 11 to activate the battery by igniting its heat pallets.

The shearing pin 28 and the tension element 46 of FIGS. 2 and 3, respectively, can be a failure member of any configuration, preferably having a portion that is weaker than other portions about which the failure member can fail upon experiencing the aforementioned induced all-fire acceleration levels. Such weaker portions can include a material that has one or more portions having a smaller cross-sectional area than other portions and/or different materials having a weaker strength than other portions as is known in the art.

In the prior art inertial igniter shown in the schematic of FIG. 2, the preloaded spring element 24 is provided to counter the forces generated by the no-fire accelerations in the direction of the of the arrow 27. However, once the preloaded spring biasing force level is reached as the acceleration level in the direction of the arrow 27 tends to the prescribed all-fire acceleration level, once the shearing pin 28 has been sheared, the striker element 22 begins to be accelerated in the clockwise direction as seen in the cross-sectional view of FIG. 2. However, as the striker element 22 rotates in the clockwise direction, the preloaded (in this case compressive) spring element 24 is further compressed and further resists the clockwise rotation of the striker element 22. As a result, an inertial igniter has to be designed for considerably higher all-fire acceleration levels so that considering the increasing counteracting force generated by the spring element 24, the striker element can still gain enough rotational velocity, i.e., kinetic energy, to reliably ignite the pyrotechnic material as was previously described. This characteristic of the inertial igniters of the prior art of the type shown in FIG. 2 with shearing pins or similarly with the types provided with tension element 46 for tensile stress failure shown in FIG. 3, results in the shortcoming of making them only useful for munitions with relatively high setback acceleration levels, where the highest no-fire acceleration level is significantly lower than the all-fire setback acceleration levels.

As a result, the inertial igniters of the types shown in FIGS. 2 and 3 can only provide the required level of operational reliability when designed for operation at setback acceleration levels that are significantly higher (sometimes 5-10 times higher) than the highest no-fire acceleration levels. The requirement of such significant difference between the no-fire and all-fire setback acceleration levels is also important to be considered since shearing and tensile failure stress levels (such as shearing pin 28 and tension element 46 of FIGS. 2 and 3, respectively), and in fact the stress levels required for all other modes of material failure, is impossible to accurately predict and in general is widely variable. As a result, to achieve the usually required high operational reliability (sometimes over 99.9 percent reliability at 95 percent confidence level), the difference between the no-fire and all-fire setback acceleration levels must be very high.

SUMMARY

The need to differentiate accidental and initiation accelerations by the resulting shock loading level of the event necessitates the employment of a safety system, which is capable of allowing initiation of the igniter only during high total impulse levels. An inertial igniter that combines such a safety system with an impact based initiation system and its alternative embodiments are described herein together with alternative methods of initiation pyrotechnics.

A need therefore exists for mechanical inertial igniters for thermal batteries and the like for gun-fired munitions, mortars and the like that are subjected to high G setback accelerations during the launch, e.g., setback acceleration levels of 10-30,000 Gs or even higher. Such inertial igniters must be significantly smaller in height and preferably also significantly smaller in volume as compared to the currently available inertial igniters for thermal batteries and the like.

Such inertial igniters must be safe in general, and in particular should not initiate if dropped, for example, from up to 5 feet onto a concrete floor for certain applications; should not initiate when subjected to the specified no-fire acceleration levels; should be able to be designed to ignite at specified (all-fire) setback acceleration levels; should withstand high firing accelerations, for example up to 20-50, 000 Gs, and do not cause damage to the thermal battery.

Reliability is also of great importance since in most munitions that use a thermal battery, the munitions relies on the battery to ensure its proper operation and prevent the munitions from becoming an unexploded ordinance. In addition, gun-fired munitions and mortars and the like are generally required to have a shelf life of up to 20 years and could generally be stored at temperatures of sometimes in the range of −65 to 165 degrees F. These requirements are usually satisfied best if the igniter pyrotechnic is in a hermetically sealed compartment or is inside the hermetically sealed thermal battery. The inertial igniters must also consider the manufacturing costs and simplicity in design to make them cost effective for munitions applications.

In addition, to ensure safety, inertial igniters should not initiate during acceleration events which may occur during manufacture, assembly, handling, transport, accidental drops, etc.

Those skilled in the art will appreciate that the inertial igniters disclosed herein provide the advantage of providing inertial igniters that are significantly shorter and generally smaller in volume than currently available inertial igniters for thermal batteries or the like, which is particularly important for small thermal batteries, while satisfying the aforementioned safety and reliability requirements for munitions applications.

Accordingly, an inertial igniter for igniting a thermal battery upon a predetermined acceleration event is provided. The inertial igniter comprising: a base having a first projection; a striker mass rotatably connected to the base through a rotatable connection, the base having a second projection aligned with the first projection such that when the striker mass is rotated towards the base, the first projection impacts the second projection; a rotation prevention mechanism for preventing impact of the first and second projections unless the predetermined acceleration event is experienced; and a spring for biasing the striker mass in a biasing direction away from the base, the spring being disposed between a portion of the striker mass and a portion of the rotation prevention mechanism.

The rotation prevention mechanism can comprise a restriction member for restricting rotation of the sticker mass, the restriction member being disposed directly or indirectly between the striker mass and the base. The restriction member can have a weakened portion which fails upon the predetermined acceleration event thereby allowing the striker mass to rotate towards the base. The restriction member can be arranged in shear and the weakened portion can be a reduced cross-sectional portion. The restriction member can be arranged in tension and the weakened portion can be a reduced cross-sectional portion.

The inertial igniter can further comprise a stop for limiting the movement of the striker mass in the biasing direction.

In the above descriptions, the striker element of the inertial igniter was considered to move in rotation towards the igniter base to initiate the igniter pyrotechnic material. Alternatively, and as is described in related embodiments, similarly functioning inertial igniters may be constructed in which the striker motion is linear rather than rotational.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

The safety related no-fire acceleration level requirements for inertial igniters that are used to initiate thermal batteries or other devices in gun-fired munitions, mortars or the like that are subjected to high-G setback (or impact) accelerations during the launch (or events such as target impact) are generally significantly higher than those that could occur accidentally, such as a result of the aforementioned drops from the 5 feet heights over concrete floors. In general, the no-fire safety requirement translates to the requirement of no initiation at acceleration levels of around 2000 Gs with a duration of approximately 0.5 msec. However, for initiation devices that are subjected to setback acceleration levels of 10-30,000 Gs or even higher, the no-fire acceleration levels are set at well above the 2000 G levels that munitions can experience when accidentally dropped over concrete floor from indicated heights of up to 5 feet. As a result, the no-fire acceleration levels for such munitions are set significantly higher than those that can be experienced during accidental drops.

In the following description and for the purpose of illustrating the methods of designing the disclosed inertial igniter embodiments to satisfy the prescribed no-fire and all-fire requirements of each munitions, a no-fire acceleration level of 3000 G (significantly higher than the accidental acceleration levels that may be actually experienced by the inertial igniter) and an all-fire acceleration level of 15000 G (significantly higher than the prescribed no-fire acceleration level of 3000 G) for a duration exceeding 4 msec will be used. It is, however, noted that as long as the prescribed no-fire acceleration level is significantly higher than those that may be actually experienced during accidental drops or the like and as long as the prescribed all-fire acceleration level is significantly higher than the prescribed no-fire acceleration level and its duration is long enough to cause the striker mass of the inertial igniter to gain enough energy (velocity) to initiate the igniter pyrotechnic material, then the disclosed novel methods and various embodiments to fabricate highly reliable and low cost inertial igniters for the munitions at hand. Here, two acceleration levels are considered to have a significant difference if considering the existing range of their distributions about the indicated values, their extreme values would still be a significant amount (e.g., at least 500-1000 G) apart.

Figure 4:
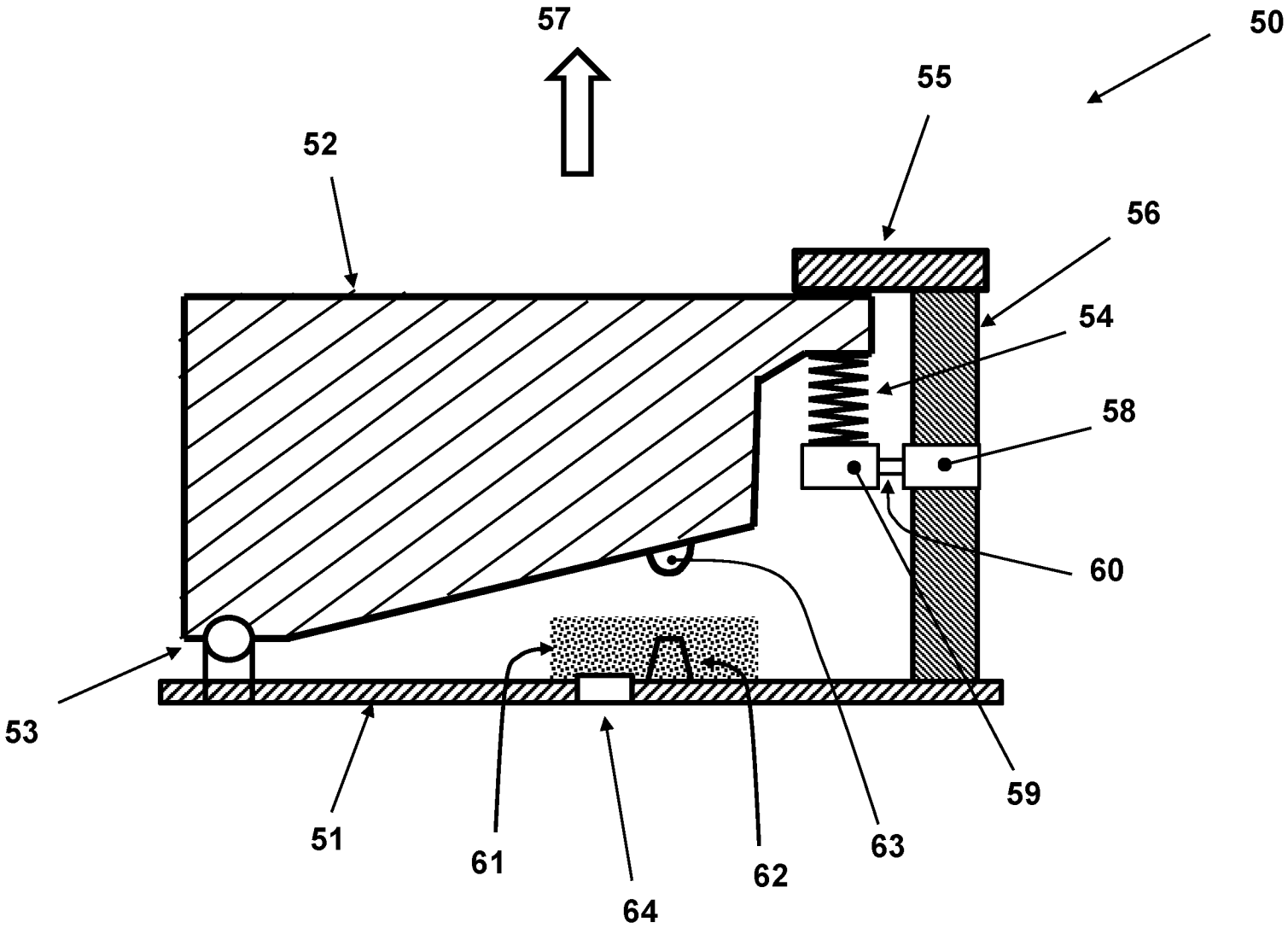
FIG. 4 illustrates the schematic of the cross-section view of the first embodiment of the inertial igniter of the present invention.

The schematic of the cross-sectional view of the first embodiment 50 of the inertial igniter is shown in FIG. 4. The inertial igniter 50 can be cylindrical in shape since most thermal batteries are constructed in cylindrical shapes, however, may be constructed in any other appropriate geometry to fit the intended application at hand. The inertial igniter 50 consists of a base element 51, which in a thermal battery construction shown in FIG. 1 would be positioned in the housing 10 with the base element 51 positioned on the top of the thermal battery cap 19. The striker mass 52 of the inertial igniter is attached to the base element 51 via a rotary joint 53.

In the embodiment 50, the striker mass 52 is kept separated from the base element 51 by a spring element 54 which biases the striker mass 52 away from the base element 51 as shown in FIG. 4. A stop element 55 is provided to limit the counterclockwise rotation of the striker mass 52 relative to the base element 51. The stop element 55 is attached to the post 56, which is in turn attached to the base element 51 of the inertial igniter 50. The spring element 54, can be a compressive spring, is positioned between the striker mass 52 and the end 59 of a shearing pin 58, which is fixedly attached to the post 56, as shown in FIG. 4.

The spring element 54 can be preloaded in compression such that with the no-fire acceleration acting on the base element 51 of the inertial igniter in the upward direction, as shown by the arrow 57, the inertia force due to the mass of the striker mass 52 would not overcome (or at most be equal to) the preloading force of the spring element 54. As a result, the inertial igniter 50 is ensured to satisfy its prescribed no-fire safety requirement.

The shearing pin 58 is fixed to the post 56 on one end while its other end 59 is used to support the spring element 54 as seen in FIG. 4. The shearing pin 58 is provided with a narrow neck 60, which provides for concentrated stress when the striker mass 52 is pressed down towards the base element 51 due to all-fire acceleration in the direction of the arrow 57 acting on the inertia of the striker mass 52. By properly designing the geometry of the shearing pin 58 and its neck 59 and selection of the proper material for the shearing pin 58, the shearing pin 58 can be designed to fracture in shear (or in any other mode) during the all-fire event as described later in this disclosure, thereby releasing the striker mass 52 and allowing it to be accelerated in the clockwise rotation. By selecting a proper mass and moment of inertial for the striker mass 52 and the required range of clockwise rotation for the striker mass 52, it would gain enough kinetic energy to initiate the pyrotechnic material 61 between the pinching points provided by the protrusions 62 and 63 on the base element 51 and the bottom surface of the striker mass 52, respectively. The ignition flame and sparks can then travel down through the opening 64 provided in the base element 61. When assembled in a thermal battery similar to the thermal battery 16 of FIG. 1, the inertial igniter is mounted in the housing 10 such that the opening 64, FIG. 4, at least partially overlaps with the opening 12 into the thermal battery 11 to activate the battery by igniting its heat pallets.

It is will be appreciated by those skilled in the art that the duration of the all-fire acceleration level is also important for the proper operation of the inertial igniter 50 by ensuring that the all-fire acceleration level is available long enough to accelerate the striker mass 52 towards the base element 51 to gain enough kinetic energy to initiate the pyrotechnic material 61 as described above by the pinching action between the protruding elements 62 and 63.

Figure 1:
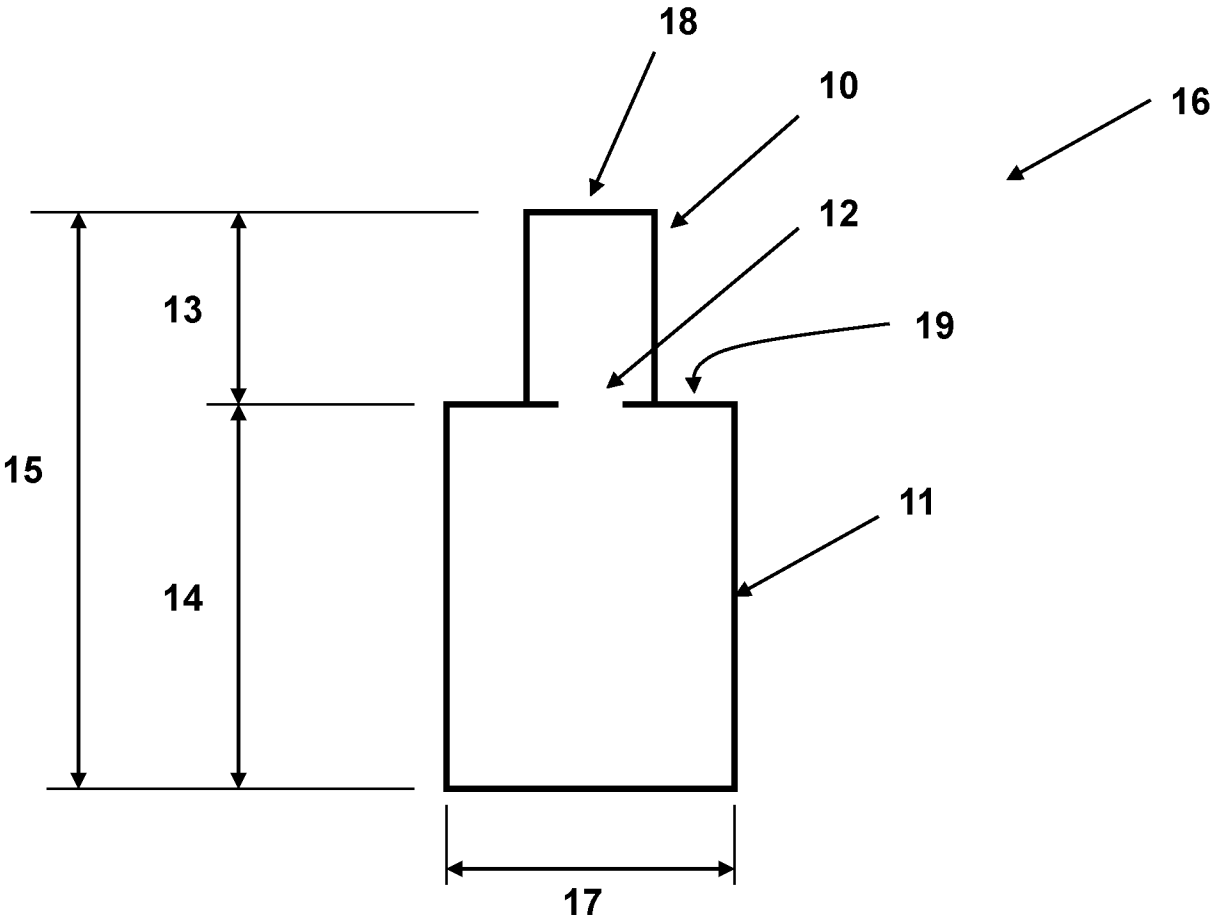
Figure 1 (PRIOR ART)
FIG. 1 illustrates a schematic of a cross-section of a thermal battery and inertial igniter assembly of the prior art.

It will also be appreciated by those skilled in the art that when the inertial igniter 50 (FIG. 4) is assembled inside the housing 10 of the thermal battery assembly 16 of FIG. 1, a cap 18 (or a separate internal cap—not shown) is commonly used to secure the inertial igniter 50 inside the housing 10. In such assemblies, the stop element 55 is no longer functionally necessary since the striker mass 52 is prevented by the cap from tending to rotate in the counterclockwise direction by the spring element 54. By providing the stop element 55, the storage of the inertial igniter 50 and the process of assembling it into the housing 10 is significantly simplified since one does not have to provide secondary means to keep the spring element 54 from rotating the striker mass 52 away from the base 51, i.e., from rotating it in the counterclockwise direction.

It will also be appreciated by those skilled in the art that the shearing pin 58 can be a failure member of any configuration, such as having a portion that is weaker than other portions about which the failure member can fail upon experiencing the aforementioned induced all-fire acceleration levels. Such weaker portions can include a material that has one or more portions having a smaller cross-sectional area than other portions and/or different materials having a weaker strength than other portions as is known in the art.

Figure 2:
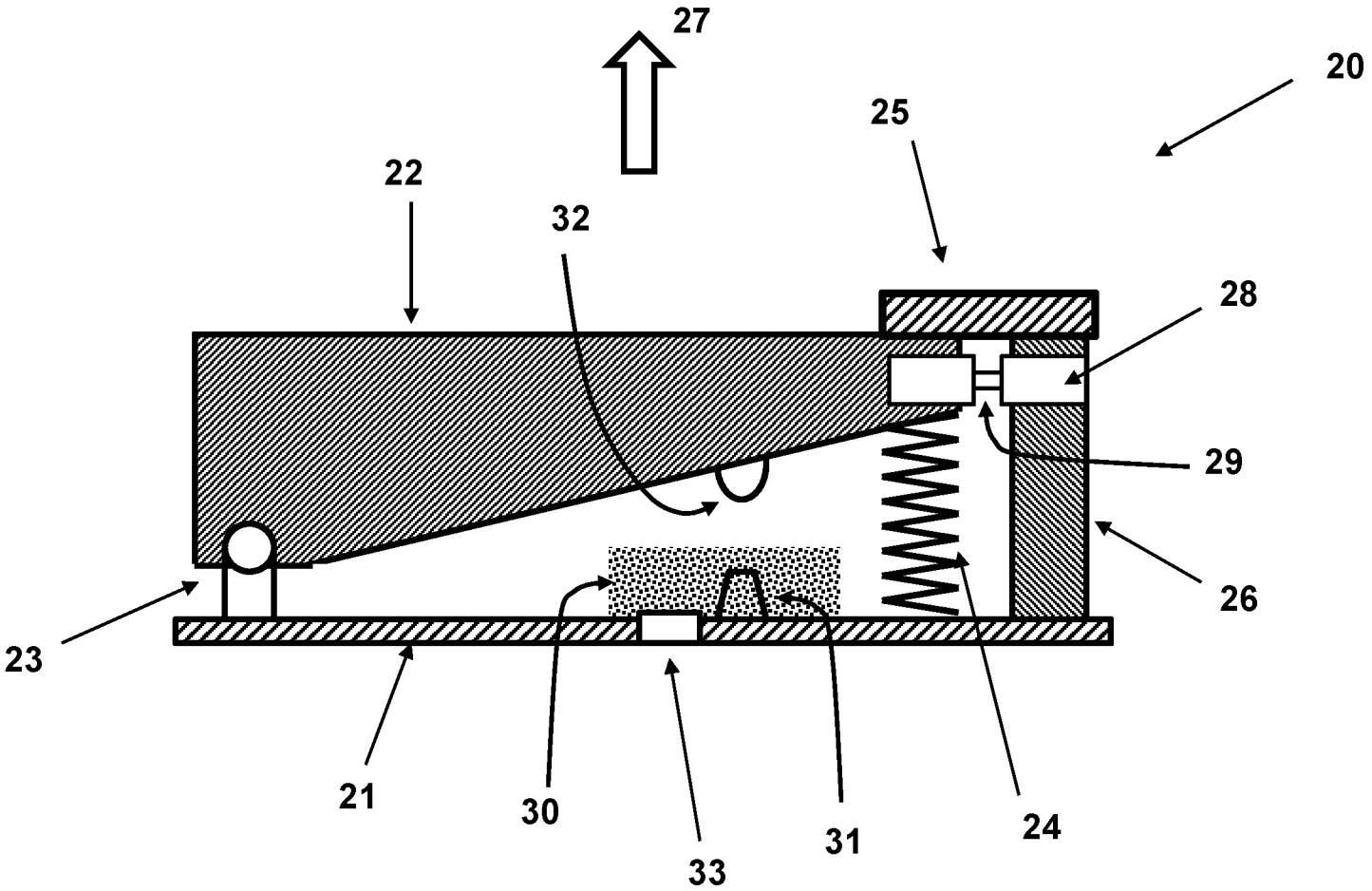
Figure 2 (PRIOR ART)
FIG. 2 illustrates a schematic of a cross-section of an inertial igniter embodiment of the prior art.
Figure 3:
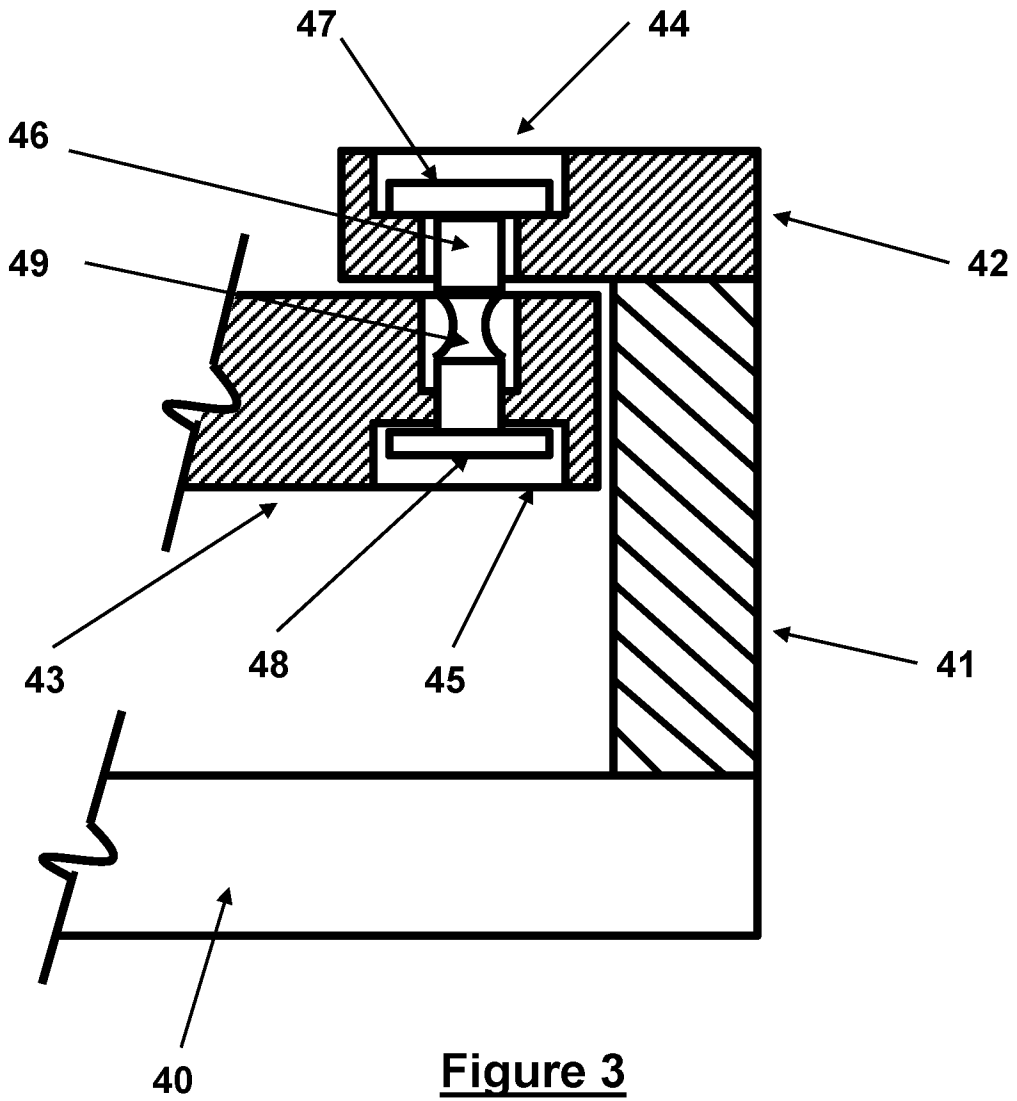
Figure 3 (PRIOR ART)
FIG. 3 illustrates a schematic of the cross-section of a tensile-mode failure element of a second inertial igniter embodiment of the prior art.

As it was noted for the prior art inertial igniters shown in the schematics of FIGS. 2 and 3, the preloaded spring element 24 is provided to counter the forces generated by the no-fire accelerations in the direction of the of the arrow 27. However, once the preloaded spring biasing force level is reached as the acceleration level in the direction of the arrow 27 tends to the prescribed all-fire acceleration level, once the shearing pin 28 has been sheared, the striker element 22 begins to be accelerated in the clockwise direction as seen in the cross-sectional view of FIG. 2. However, as the striker element 22 rotates in the clockwise direction, the preloaded (in this case compressive) spring element 24 is further compressed and further resists the clockwise rotation of the striker element 22. As a result, an inertial igniter has to be designed for considerably higher all-fire acceleration levels so that considering the increasing counteracting force generated by the spring element 24, the striker element can still gain enough rotational velocity, i.e., kinetic energy, to reliably ignite the pyrotechnic material as was previously described. This characteristic of the inertial igniters of prior art of the type shown in FIG. 2 with shearing pin 28 or similarly with the types provided with tension element 46 for tensile stress failure shown in FIG. 3, results in the shortcoming of making them only useful for munitions with relatively high setback acceleration levels, where the highest no-fire acceleration level is significantly lower than the all-fire setback acceleration levels.

As a result, the prior art inertial igniters of the types shown in FIGS. 2 and 3 can only provide the required level of operational reliability when designed for operation at setback acceleration levels that are significantly higher (sometimes 5-10 times higher) than the highest no-fire acceleration levels. As a result, to achieve the usually required high operational reliability (sometimes over 99.9 percent reliability at 95 percent confidence level), the difference between the no-fire and all-fire setback acceleration levels must be very high.

The inertial igniters of the type of the embodiment 50 shown in FIG. 4, however, do not suffer from the above significant shortcoming of the aforementioned prior art type inertial igniters shown in FIGS. 2 and 3. This is the case since as can be seen in FIG. 4, once the inertial igniter is subjected to the setback acceleration in the direction of the arrow 57, the striker element 52 first compresses the compressive spring 54 to its solid length, then keeps applying an increasing shearing force to the shearing pin 58 as the setback acceleration level is increased, then shears off the shearing pin 58, and then accelerates the striker element 52 in clockwise rotation to gain enough kinetic energy to initiate the pyrotechnic material 61 as described previously by the pinching action between the protruding elements 62 and 63.

Here, it is appreciated by those skilled in the art that in the inertial igniter embodiment 50, the latter said clockwise acceleration of the striker element following shearing of the shearing pin 58 is not counteracted by the preloaded spring element 54, as was shown to be the case for the aforementioned prior art inertial igniters types shown in FIGS. 2 and 3. As a result, the aforementioned significant shortcoming of this type of inertial igniters of the prior art is overcome, and the difference between the maximum no-fire and all-fire setback acceleration levels does not have to be very high, and the inertial igniters of this type, which have the great advantage of being very small and inexpensive to produce, can then be used in munitions with significantly lower setback acceleration levels.

It is noted that in place of the shearing pin 58, other types of elements that are designed to fracture upon the application of the all-fire acceleration as described above and release the striker mass 52 may be used to perform the same function. For example, the mode of fracture may be selected to be in tension, torsion or pure bending. In general, the fracture is desired to be achieved with minimal deformation in the direction that results in a significant clockwise rotation of the striker mass 52 prior to pin fracture and its release. This would result in minimum inertial igniter height since the amount of clockwise rotation that the striker mass 52 must undergo following its release by the applied setback acceleration to gain enough kinetic energy to reliably ignite the pyrotechnic material is reduced.

Figure 5:
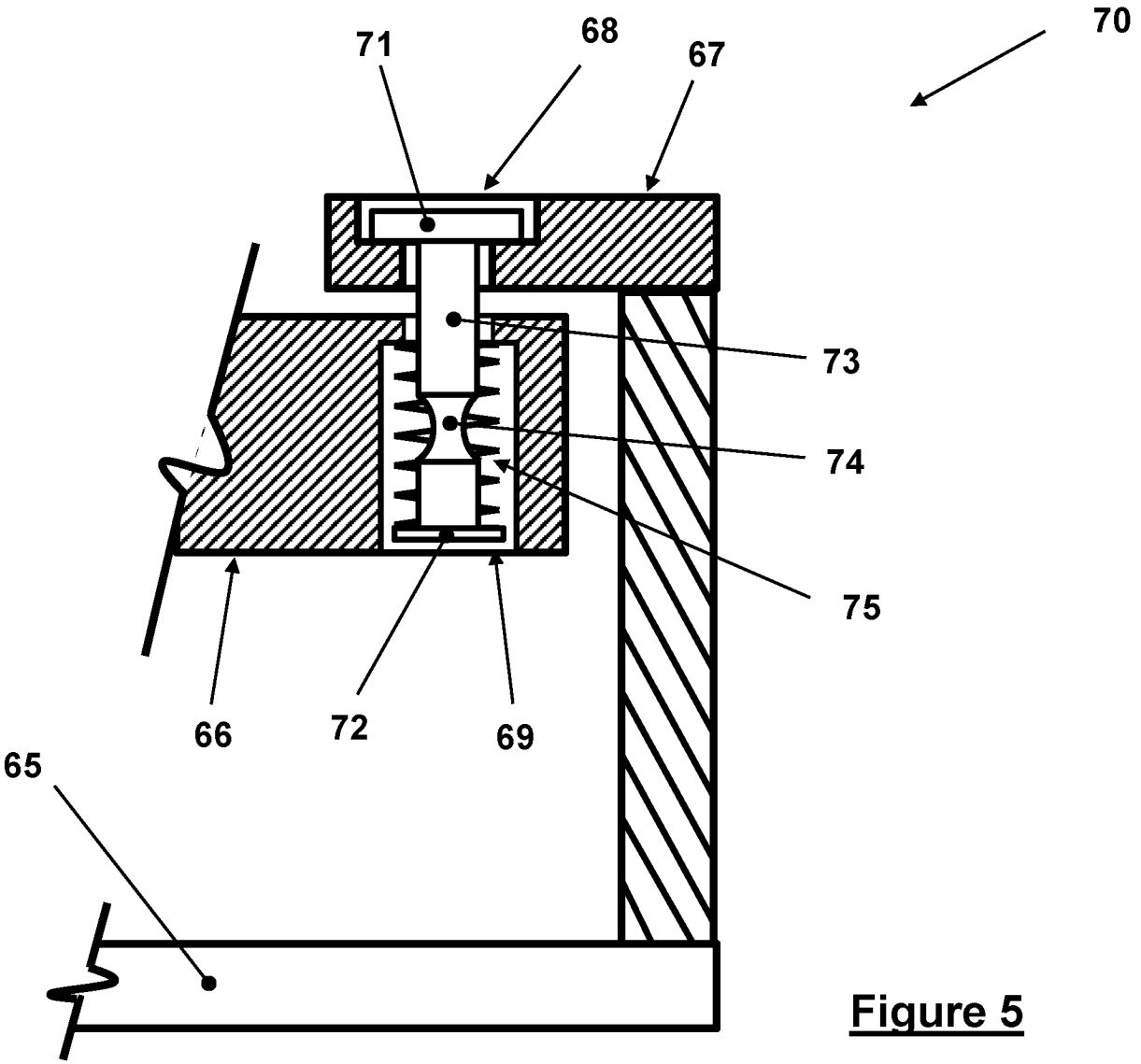
FIG. 5 illustrates the schematic of the alternative embodiment of the first inertial igniter embodiment of the present invention shown in FIG. 4.

An example of an alternative embodiment 70 of the inertial igniter embodiment of FIG. 4 in which the shearing pin 58 is replaced by an element designed to fracture in tension when the inertial igniter is subjected to the aforementioned all-fire acceleration is shown in FIG. 5. In FIG. 5, only a portion of the base element 65 and the front portion of the striker mass 66 (51 and 52 in FIG. 4, respectively) are shown. The stop element 67 is provided with a hole and countersink 68 as shown in FIG. 5. An opposite hole and countersink 69 is provided in the striker mass 66. A one-piece tension element 73 (which can be cylindrical in shape) with top and bottom flange portions 71 and 72, respectively, is also provided. The top flange portion 71 of the tension element 73 is assembled seating in the countersink 68 of the stop element 67 and the bottom flange portion 72 of the tension element 73 is assembled seating in the countersink 69 of the striker mass 66. The stop element 67 and the striker mass 66 can be provided with passages (not shown) for assembling the tension element 73. Alternatively, the tension element 73 may be a two-part element that is assembled in place as shown in FIG. 5, such as by riveting, welding or otherwise fastening the flange 71 to the stem portion of the tension element 73. The tension element 73 is also provided with a narrow neck portion 74, which provides for concentrated stress when the striker mass 66 is pressed down towards the base element 65 due to all-fire acceleration in the direction of the arrow 57 (FIG. 4) acting on the inertia of the striker mass 66.

By properly designing the geometry of the tension element 73 and its neck portion 74 and selection of the proper material, the tension element 73 can be designed to fracture in tension when the inertial igniter is subjected to a prescribed setback acceleration event, thereby releasing the striker mass 66 and allowing it to be accelerated in the clockwise rotation. As a result, for a properly designed inertial igniter, i.e., by selecting a proper mass and moment of inertial for the striker mass 66; and providing the required range of clockwise rotation for the striker mass 66; the striker mass 66 will gain enough kinetic energy to initiate the pyrotechnic material 61 between the pinching points provided by the protrusions 62 and 63, as shown in the schematics of FIG. 4. The ignition flame and sparks will then travel down through the opening 64 provided in the base element 65 as shown in FIG. 4. When assembled in a thermal battery similar to the thermal battery 16 of FIG. 1, the inertial igniter is mounted in the housing 10 such that the opening 64 is lined up with the opening 12 into the thermal battery 11 to activate the battery by igniting its heat pallets.

It will be appreciated by those skilled in the art that similar to the inertial igniter type of embodiment 50 of FIG. 4, the inertial igniter types of the embodiment 70, FIG. 5, also do not suffer from the aforementioned significant shortcoming of the prior art type inertial igniters shown in FIGS. 2 and 3. This is the case since as can also be seen in FIG. 5, once the inertial igniter is subjected to the setback acceleration in the direction of the arrow 57, the striker element 66 first compresses the compressive spring 75 to its solid length, then keeps applying an increasing tensile force to the tension element 73 as the setback acceleration level is increased, eventually causing the tension element 73 to fail in tension, and then accelerate the striker element 66 in clockwise rotation to gain enough kinetic energy to initiate the pyrotechnic material 61 as described previously by the pinching action between the protruding elements 62 and 63. The spring 75 can be preloaded.

It will be appreciated by those skilled in the art that similar to the inertial igniter embodiment 50 of FIG. 4, the clockwise acceleration of the striker element 66 following the tensile failure of the tension element 73 is no longer counteracted by the spring element 75, as was shown to be the case for the aforementioned prior art inertial igniters types shown in FIGS. 2 and 3. As a result, the aforementioned significant shortcoming of this type of inertial igniters of the prior art is overcome, and the difference between the maximum no-fire and all-fire setback acceleration levels do not have to be very high, and the inertial igniters of this type, which have the great advantage of being very small and inexpensive to produce, can then be used in munitions with significantly lower setback acceleration levels.

In the inertial igniter embodiment of FIG. 5, the compressive spring 75 is shown to be assembled around the tension element 73 and positioned between the bottom flange portion 72 of the tension element 73 and the striker element 66, inside the provided countersink 69. It will be, however, appreciated by those skilled in the art that the compressive spring 75 may also be positioned between the top flange portion 72 of the tension element 73 and the stop element 67, inside the bottom surface of the countersink 68, to perform the same aforementioned function.

It will also be appreciated by those skilled in the art that in general, the stiffness of the compressive spring 75 can be selected such that the amount of deformation that it needs to undergo before it reaches its solid length and the resulting clockwise rotation of the striker element 66 is small before it reaches its solid length. It will also be appreciated by those skilled in the art that the force exerted by the compressive spring 75 on the striker element 66 as it reaches its said solid length can be equal or close to the maximum no-fire acceleration level in the direction of the arrow 57, FIG. 4, that the inertial igniter is expected to experience.

Figure 6:
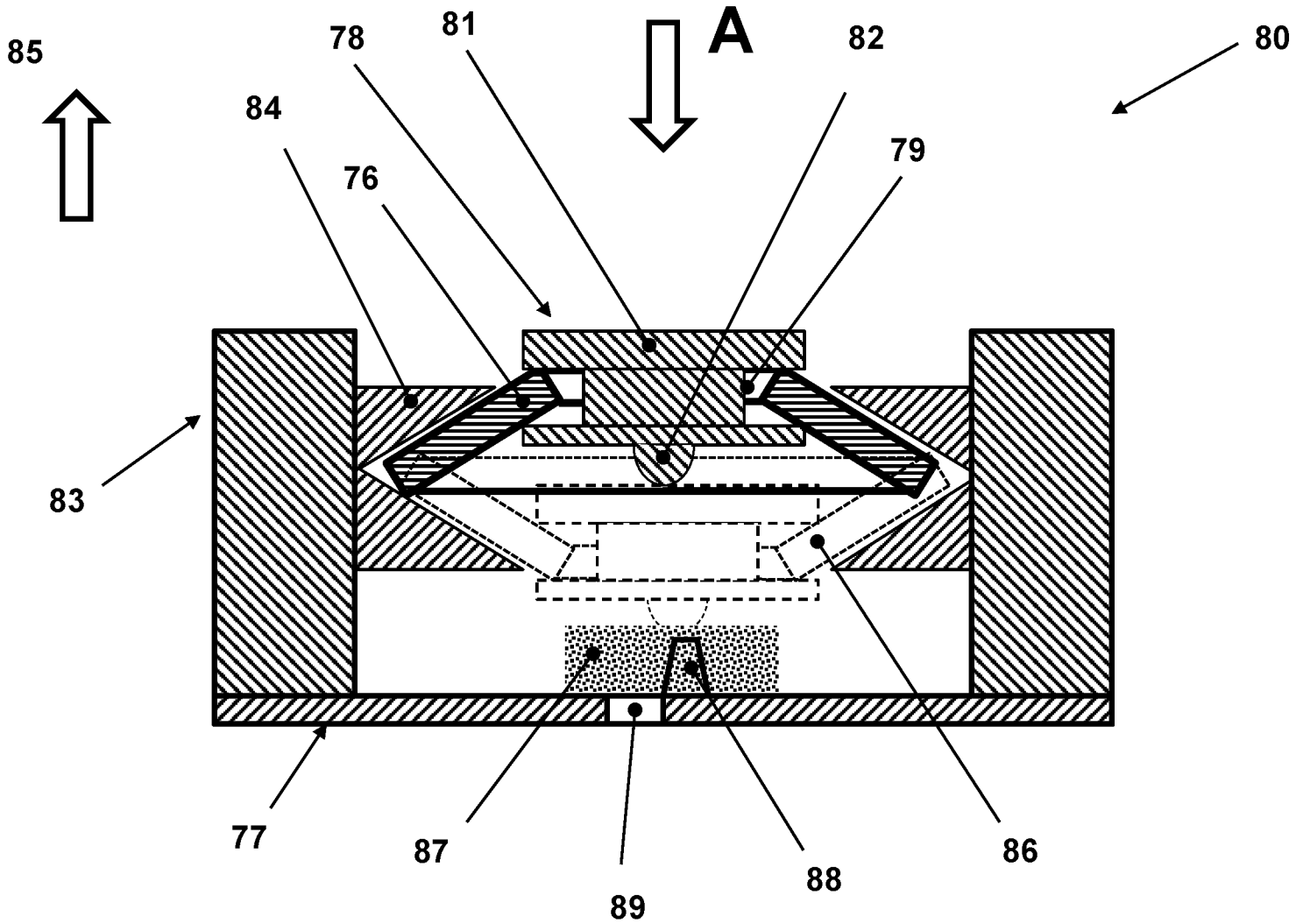
FIG. 6 illustrates the schematic of the cross-section view of the second embodiment of the inertial igniter of the present invention.

A schematic of the cross-sectional view of a second embodiment 80 of the inertial igniter is shown in FIG. 6. The inertial igniter 80 can be cylindrical in shape since most thermal batteries are constructed in cylindrical shapes. It will be, however, appreciated by those skilled in the art that it may also be constructed in any other appropriate geometry to fit the intended application at hand.

The inertial igniter 80 consists of a base element 77, which in a thermal battery construction shown in FIG. 1 would be positioned in the housing 10 with the base element 77 positioned on the top of the thermal battery cap 19. The striker mass 78 of the inertial igniter can be cylindrical and is mounted inside the provided hole in a "bending type" spring element 76, the different possible design and mode of operation of which is to be later described, as shown in FIG. 6. The "bending type" spring element 76 is held in the position and configuration shown by the provided mating groove 79. The striker mass 78 can be of a two-part construction that is assembled in place in the "bending type" spring element 76 as shown in FIG. 6, such as by riveting, welding or otherwise fastening of one portion, such as the top flange 81 to another part of the striker mass 78. The striker mass is also provided with a protrusion 82, which can be relatively sharp with a round end as is commonly used for pyrotechnic material initiation and described later in this disclosure.

The base element 77 is provided with a support structure 83, which can be a cylindrically shaped ring of appropriate height, which is provided with an internal ring 84. The internal ring 84 in turn is provided with a wedge shape internal cut within which the "bending type" spring element 76 assembly with the striker mass 78 is positioned. It will be appreciated by those skilled in the art that the internal ring 84 may be an integral part of the structure 83 or that the groove for the "bending type" spring element 76 assembly may be provided in the structure 83 itself. However, in some cases and from an assembly process point of view it may be easier to assemble the "bending type" spring element 76 into a separate ring 84 and then assemble the ring 84 inside the structure 83.

Figure 7C:
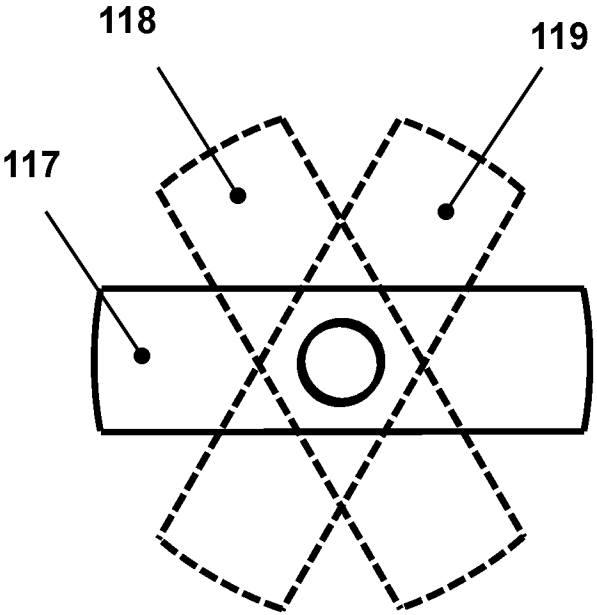
FIG. 7C illustrates the option of using more than one (three in this illustration) "bending type" spring element of FIG. 7A in the inertial igniter embodiment of FIG. 6.
Figure 7A:
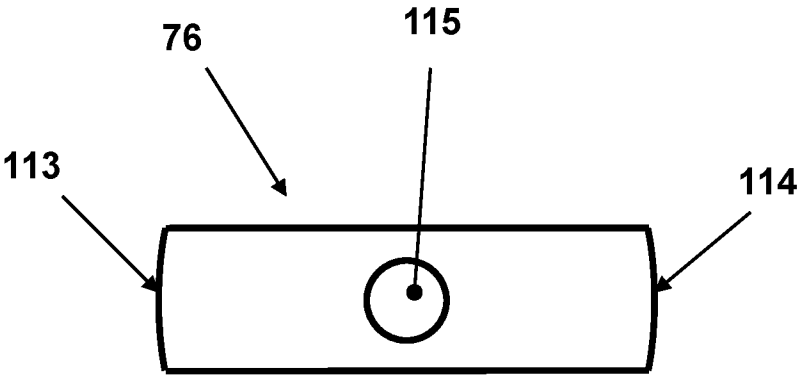
FIG. 7A illustrates the top view of the first general geometry of the "bending type" spring element of the inertial igniter embodiment of FIG. 6.

The top view "A" of the inertial igniter indicated in the schematic of FIG. 6 is shown in FIG. 7A. In FIG. 7A only the "bending type" spring element 76 is shown and is used to present one possible geometry of the spring element. It will be appreciated by those skilled in the art that the "bending type" spring element 76 may be constructed in numerous geometries to provide the aforementioned functionality for the proper operation of the inertial igniter embodiment 80 of FIG. 6. The main requirement for any such geometry is that the "bending type" spring element must be constructed essentially flat, so that by bending to the configuration shown in FIG. 6 to fit inside the wedge shape internal cut in the internal ring 84, potential energy is stored in the "bending type" spring element so that it can function as described below for the operation of the inertial igniter 80 of FIG. 6.

Figure 7B:
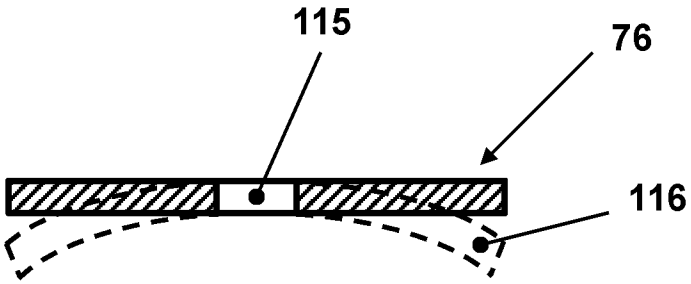
FIG. 7B illustrates the cross-sectional side view of the "bending type" spring element of FIG. 7A.

In the schematic of FIG. 7A, the "bending type" spring element 76 is shown to be constructed as a strip element with a central hole 115 to accommodate the striker mass 78 as shown in FIG. 6. The "bending type" spring element 76 is fabricated flat as shown in FIG. 7A and in solid lines in the cross-sectional view (though the center of the spring strip) of FIG. 7B, with its sides 113 and 114 being curves to fit inside the wedge shape internal cut in the internal ring 84 as shown in FIG. 6. The "bending type" spring element 76 is then bent from its flat shape shown in solid lines in the cross-sectional view FIG. 7B to its bent configuration shown in dashed lines in FIG. 7B (indicated by the numeral 116) and assembled (which can be after the striker mass 78 has been assembled) inside the wedge shape internal cut in the internal ring 84 as shown in FIG. 6. The "bending type" spring element 76 can be made out of relatively thin spring material so that it can be bent to the configuration 116 without causing permanent deformation while storing a significant amount of potential energy.

It will be appreciated by those skilled in the art that more than one "bending type" spring element 76 (indicated by the numerals 117, 118 and 119) in FIG. 7C may be assembled in the inertial igniter embodiment of FIG. 6. For example, three such "bending type" spring elements 76 may be stacked in a star-shaped (around 120 deg. angles) as shown in FIG. 7C. The lengths of the top "bending type" spring elements may be required to be slightly longer if the springs are slightly thick and/or if they are relatively short (for small diameter inertial igniters).

Figure 7D:
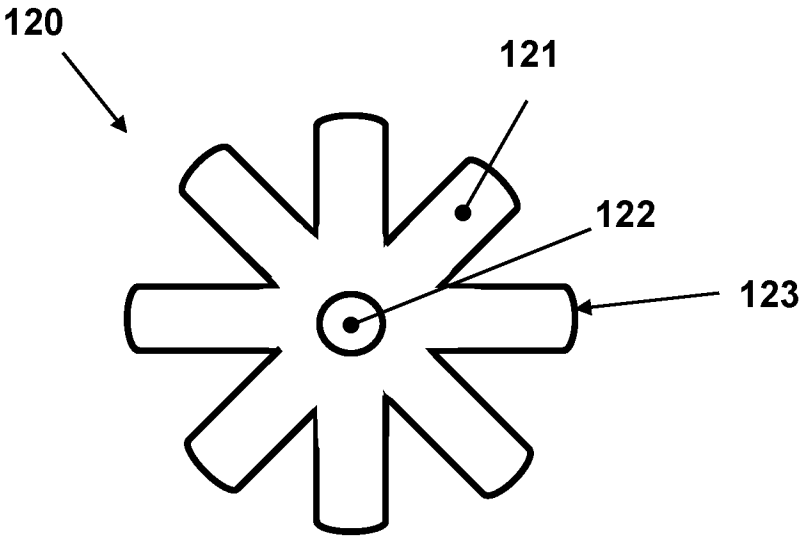
FIG. 7D illustrates the top view of the second general geometry of the "bending type" spring element of the inertial igniter embodiment of FIG. 6.

Alternatively, the "bending type" spring element 76, FIG. 6, may be integrally fabricated in a star shape as shown in FIG. 7D and indicated by the numeral 120. In FIG. 7D the "bending type" spring element 120 is shown with eight extensions 121, however, it will be appreciated that more or fewer number of extensions 121 may also be selected. Similar to the "bending type" spring element 76 shown in FIGS. 7A and 7B, the "bending type" spring element 120 is constructed flat with a relatively thin spring material and is provided with curved ends 123 of the extensions 121 to fit inside the wedge shape internal cut in the internal ring 84 as shown in FIG. 6.

In the "bending type" spring element 76 configuration shown in solid lines in FIG. 6, the assembled striker mass 78 is kept separated from the base element 77. It will be appreciated by those skilled in the art that as the inertial igniter is accelerated in the direction of the arrow 85 due to setback acceleration during munitions firing, the resulting inertial force due to the combined mass of the striker mass 78 and the "bending type" spring element 76 will act on the "bending type" spring element 76 and tend to deform it down as seen in the schematic of FIG. 6, towards its flattened state. Now if the setback acceleration is high enough and the combined mass of the striker mass 78 and the "bending type" spring element 76 is large enough, i.e., if the resulting inertial force is larger than the force needed to flatten the "bending type" spring element 76, then the spring element 76 together with the striker mass 78 move down passed the flattened configuration of the "bending type" spring element 76, accelerate downward due to the stored potential energy in the flattened "bending type" spring element 76 as well as the firing setback acceleration. The "bending type" spring element 76 together with the striker mass 78 will then reach the configuration shown with dashed lines and indicated by the numeral 86 in FIG. 6.

In practice, the mass of the striker mass 78 and the "bending type" spring element 76 are selected such that the inertial force generated by the maximum expected no-fire acceleration in the direction of the arrow 85 is less than the force needed to flatten the "bending type" spring element 76 towards the configuration 86. In general, a margin of safety is also considered to ensure that such a change in the "bending type" spring element 76 configuration cannot occur as a result of any no-fire acceleration events. The inertial igniter 80 is, however, provided with a striker mass 78 and the "bending type" spring element 76 assembly that as a result of the setback acceleration in the direction of the arrow 85 the generated inertial force due to the mass of the striker mass 78 and the "bending type" spring element 76 is larger than the force needed to flatten the "bending type" spring element 76. As a result, the "bending type" spring element 76 together with the striker mass 78 move down past the flattened configuration of the "bending type" spring element 76, accelerate downward due to the stored potential energy in the flattened "bending type" spring element 76 as well as the firing setback acceleration towards the configuration 86 shown in dashed lines in FIG. 6. Then if the inertial igniter striker mass 78 and "bending type" spring element are selected properly for the firing setback acceleration level and duration, the striker mass 78 will gain enough energy (kinetic energy) to initiate the igniter pyrotechnic material 87 provided on the base element 77 with a thin layer covering the protrusion 88 as seen in FIG. 6. As was previously described for the embodiment of FIG. 4, the igniter pyrotechnic initiation is commonly achieved reliably by pinching points provided by the protrusions 88 and 82 on the base element 77 and the bottom surface of the striker mass 78, respectively.

The ignition flame and sparks will then travel down through the opening 89 provided in the base element 77 as shown in FIG. 6. When assembled in a thermal battery similar to the thermal battery 16 of FIG. 1, the inertial igniter is mounted in the housing 10 such that the opening 89 is lined up with the opening 12 into the thermal battery 11 to activate the battery by igniting its heat pallets.

Figure 8:
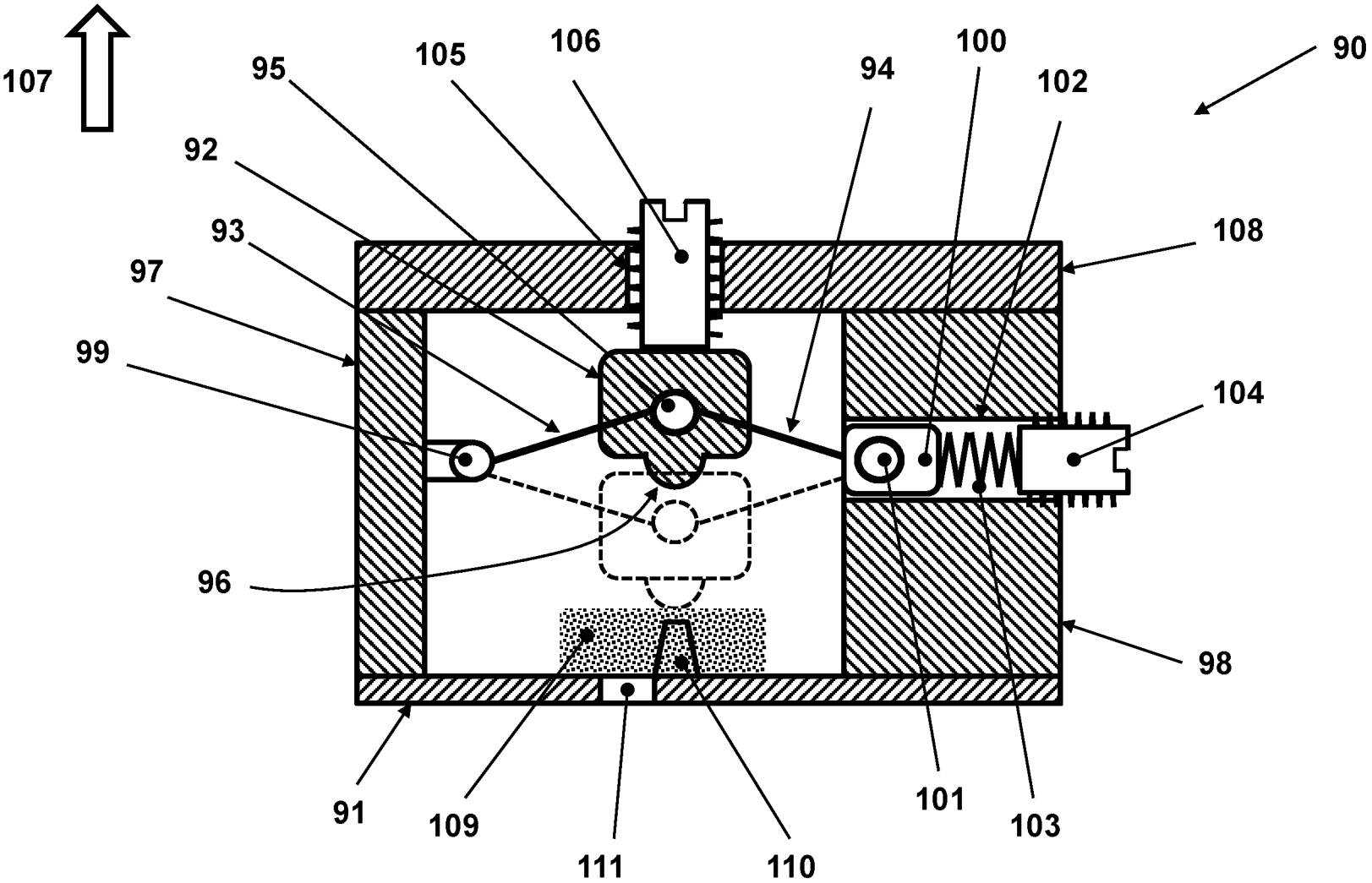
FIG. 8 illustrates the schematic of the cross-section view of the third embodiment of the inertial igniter of the present invention.

A schematic of a cross-sectional view of a third embodiment 90 of an inertial igniter is shown in FIG. 8. The inertial igniter 90 may be cylindrical in shape since most thermal batteries are constructed in cylindrical shapes. It will be, however, appreciated by those skilled in the art that it may also be constructed in any other appropriate geometry to fit the intended application at hand. The inertial igniter 80 consists of a base element 91, which in a thermal battery construction shown in FIG. 1 would be positioned in the housing 10 with the base element 91 positioned on the top of the thermal battery cap 19. The striker mass 92 of the inertial igniter, which may be cylindrical, is attached to the links 93 and 94 at their pin joint 95, such as via a joint pin (not shown) as shown in FIG. 8. The striker mass 92 can be a one-piece element with a central slot (not shown) to allow assembly and movement of the links 93 and 94. Alternatively, particularly when the size of the inertial igniter 90 allows, pairs of links 93 and 94 may be used and attached to the sides of the striker mass 92 by the joint 95 pin. The striker mass is also provided with a protrusion 96, which is relatively sharp with a rounded end as is commonly used for pyrotechnic material initiation.

The base element 91 is provided with the support structure 97 and 98, the outside surface of which can be cylindrically shaped to fit most thermal battery geometries. If the support structures 97 and 98 are an integral part of a one-piece cylindrically shaped housing, then the side 97 and 98 may have to have different thicknesses, such as having an eccentric hole, to accommodate the components of the inertial igniter as described below. The link 93 is attached to the support structure 97 by a pin joint 99. The link 94 is attached to the sliding block 100 by the pin joint 101. The sliding block 100 is free to translate in the guide 102, which is provided in the support structure 98. A compressive spring 103 is positioned in the guide 102 against the sliding block 100, which is held in a compressively preloaded state as shown in the schematic of FIG. 8 by an adjustment screw 104, which mates with a threaded end of the guide 102. In addition, to limit upward motion (in the direction of the arrow 107) of the striker mass 92 and thereby holding the links 93 and 94 and striker mass 92 assembly in the configuration shown by solid lines in FIG. 8 while adjusting the compressive preloading of the compressive spring 103, a stop, such as a screw 106 is provided in a top cover 108 as shown in FIG. 8. The top cover 108 is fixedly attached to the support structures 97 and 98, and is provided with a threaded hole 105 for mating engagement with the adjustment screw 106.

In the links 93 and 94 and striker mass 92 assembly configuration shown in solid lines in FIG. 8, the striker mass 92 is kept separated from the base element 91. It will be appreciated by those skilled in the art that the links 93 and 94 and striker mass 92 assembly is held in the configuration shown in solid lines and resist downward movement due to the force applied by the preloaded compressive spring 103. It will also be appreciated by those skilled in the art that the resistance to downward motion is present as long as the links 93 and 94 are in the configuration shown in the schematic of FIG. 8. The resistance to downward motion, however, diminishes as the links 93 and 94 move in the direction of becoming lined up (collinear). In this unstable configuration of this linkage mechanism, a slight movement of the striker mass (hinge 95) up or down will push the mechanism into the configuration shown by solid lines or into the configuration shown by dashed lines.

In the inertial igniter embodiment 90 of FIG. 8, as the inertial igniter is accelerated in the direction of the arrow 107 due to the setback acceleration during munitions firing, the resulting inertial force due to the combined mass of the striker mass 92 and the links 93 and 94 acts to counter the force exerted by the preloaded compressive spring 103. The compressive spring 103 then deforms a certain amount proportional to its spring rate, causing the links 93 and 94 configuration to come closer to their collinear configuration. Now if the setback acceleration rises high enough and the combined mass of the striker mass 92 and the links 93 and 94 is large enough, i.e., if the resulting inertial force is large enough to deform the compressive spring 103 enough to bring the links 93 and 94 into their collinear configuration, then as the setback acceleration level increases further, the force exerted by the compressive spring 103 (the potential energy stored in the compressive spring 103) as well as setback acceleration acting on the combined mass of the striker mass 92 and the links 93 and 94 will accelerate the striker mass 92 downwards towards the base 91, i.e., to the configuration shown in dashed lines in FIG. 8.

In an inertial igniter designed for certain munitions applications, the combined mass of the striker mass 92 and the links 93 and 94 and the spring rate of the compressive spring 103 and its compressive preloading level are selected such that the inertial force generated by the maximum expected no-fire acceleration in the direction of the arrow 107 would not bring the links 93 and 94 close to their collinear state. In general, a margin of safety is also considered to ensure that a change in the linkage configuration cannot occur as a result of any no-fire acceleration event.

In the inertial igniter embodiment 90 of FIG. 8, the level of compressive spring 103 preload is adjusted by the adjustment screw 104. Similarly, the position of the striker mass 92 and the links 93 and 94 in their pre-activation configuration shown by solid lines in FIG. 8 can be varied using the adjustment screw 106.

It will be therefore appreciated by those skilled in the art that for a given pre-activation positioning of the striker mass 92 and the accompanying links 93 and 94, by increasing the level of the compressive spring 103 compressive preloading, the amount of acceleration in the direction of the arrow that is needed to bring the links 93 and 94 to their aforementioned collinear state is increased. As a result, the inertial igniter can withstand higher maximum no-fire accelerations in the direction of the arrow 107.

It will also be appreciated by those skilled in the art that for a given level of compressive spring 103 compressive preloading, the closer the links 93 and 94 are brought to their collinear state by the adjustment screw 106, a smaller level of acceleration in the direction of the arrow 107 is required to bring the links into their collinear state. As a result, a lower level of acceleration in the direction of the arrow 107, i.e., a lower no-fire acceleration level, would cause the links 93 and 94 to move into their collinear state.

As was previously described, for a properly designed and adjusted inertial igniter for no-fire and all-fire setback acceleration event initiation, as the setback acceleration (in the direction of the arrow 107) increases during the munitions firing, the inertial force due to the combined mass of the striker mass 92 and the links 93 and 94 deform the compressive spring 103 enough to bring the links 93 and 94 into their collinear configuration, and then as the setback acceleration level increases further, the force exerted by the compressive spring 103 as well as the setback acceleration acting on the combined mass of the striker mass 92 and the links 93 and 94 will accelerate the striker mass 92 downwards towards the base 91, i.e., to the configuration shown in dashed lines in FIG. 8. If the igniter parameters are selected properly, the striker mass 92 will then gain enough energy (kinetic energy) to initiate the igniter pyrotechnic material 109 provided on the base element 91, with a thin layer covering over protrusion 110 as seen in FIG. 8. As was previously described for the embodiment of FIG. 4, the igniter pyrotechnic initiation is commonly achieved reliably by pinching points provided by the protrusions 110 and 96 on the base element 91 and the bottom surface of the striker mass 92, respectively.

The ignition flame and sparks will then travel down through the opening 111 provided in the base element 91 as shown in FIG. 8. When assembled in a thermal battery similar to the thermal battery 16 of FIG. 1, the inertial igniter is mounted in the housing 10 such that the opening 111 is lined up with the opening 12 into the thermal battery 11 to activate the battery by igniting its heat pellets.

Figure 9:
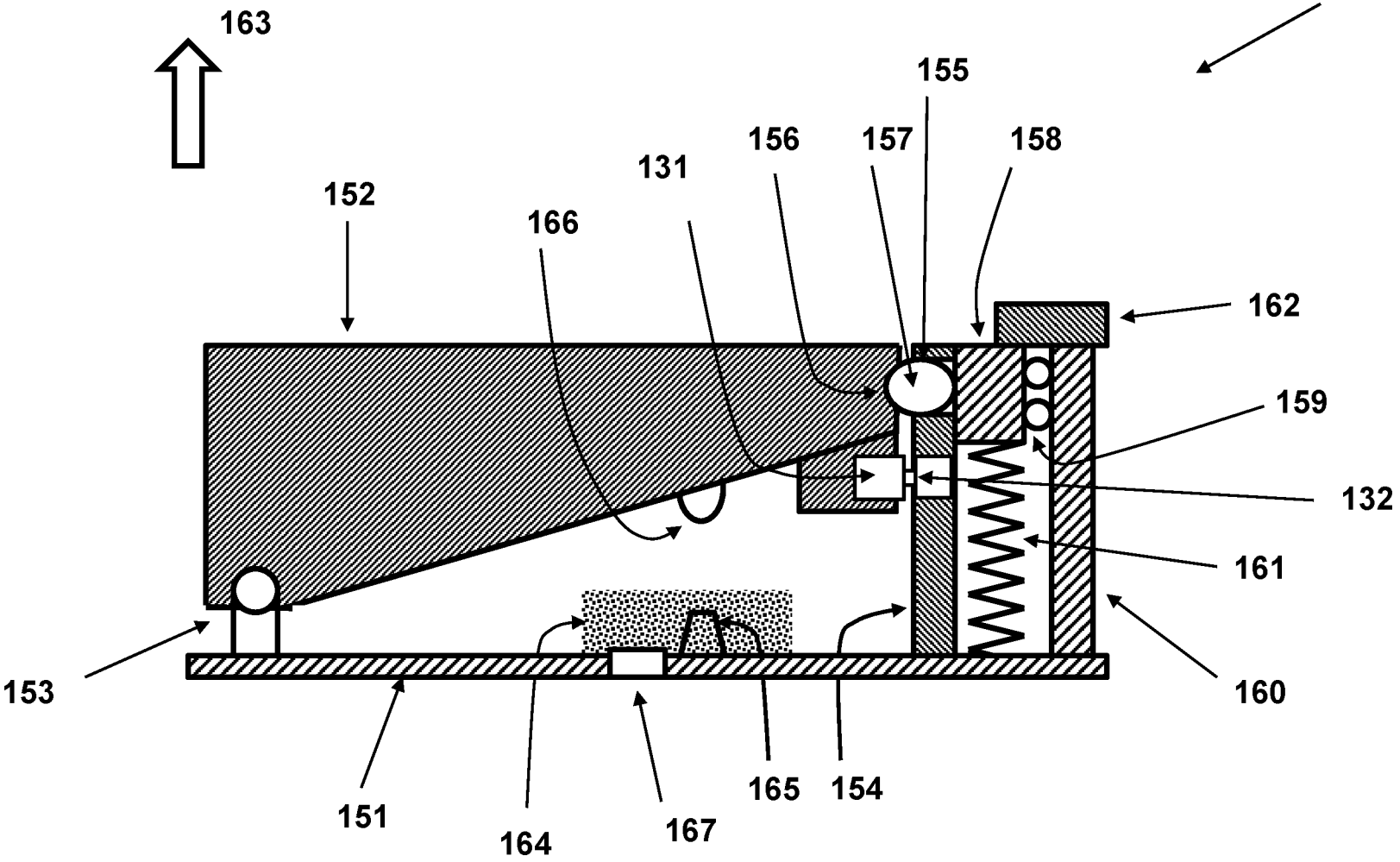
FIG. 9 illustrates the schematic of the cross-section view of the fourth embodiment of the inertial igniter of the present invention.

Another embodiment 130 is illustrated schematically in FIG. 9. Similar to the inertial igniter of embodiment 20 of FIGS. 2 and 3, the inertial igniter 130 consists of a base element 151, which in a thermal battery construction shown in FIG. 1 would be positioned in the housing 10 with the base element 151 positioned on the top of the thermal battery cap 19. The striker mass 152 of the inertial igniter 130 is attached to the base element 151 via the rotary joint 153. A post 154, which is fixed to the base element 151 is provided with a hole 155, which in the configuration shown in FIG. 8 is aligned with a dimple 156 in the striker mass 152. A ball 157 is positioned in the hole 155, extending into the dimple 156 of the striker mass 152. In the configuration of FIG. 9, the (up-down) sliding member 158 is shown to block the movement of the ball 157 out of engagement with the dimple 156 of the striker mass 152, thereby locking the striker mass 152 in the illustrated configuration. The sliding member 158 is free to slide down against a member 160 (the rolling elements 159 are provided for illustrative purposes only to indicate a sliding joint between the sliding member 158 and the surface of the member 160). The member 160 is fixed to the base element 151. A spring element 161 resists downward motion of the sliding member 158, and can be preloaded in compression so that if a downward force that is less than the compressive preload is applied to the sliding member 158, the applied force would not cause the sliding element 158 to move downwards. A stop 162, fixed to the member 160, is provided to allow the spring element 161 to be preloaded in compression by preventing the sliding member 158 from moving further up from the configuration shown in FIG. 9.

During the firing, the inertial igniter 130 is considered to be subjected to setback acceleration in the direction of the arrow 163. If a level of acceleration in the direction of the arrow 163 acts on the inertia of the sliding element 158, it would generate a downward force that tends to slide the sliding element 158 downwards (opposite to the direction of acceleration). The compression preloading of the spring element 161 is selected such that with the no-fire acceleration levels, the inertia force acting on the sliding element 158 would not overcome (or at most be equal to) the preloading force of the spring element 161. As a result, the inertial igniter 130 is ensured to satisfy its prescribed no-fire requirement. Now if the acceleration level in the direction of the arrow 163 is high enough, then the aforementioned inertia force acting on the sliding element 158 will overcome the preloading force of the spring element 161, and will begin to travel downward. If the acceleration level is applied over a long enough period of time (duration) as well, i.e., if the all-fire condition is satisfied and the sliding element 158 has enough time to travel down far enough to allow the ball 157 to be pushed out of the dimple 156, thereby releasing the striker mass 152. At this time, the striker mass 152 becomes free to rotate clockwise under the influence of the acceleration in the direction of the arrow 163. However, the striker mass 152 is "locked" to the post 154 by the shearing pin 131. The shearing pin 131 is fixed to the post 154 on one end while its other end is fixed to the striker mass 152 as shown in FIG. 9.

The shearing pin 131 is provided with a narrow neck 132, which provides for concentrated stress when the striker mass 152 is pressed down towards the base element 151 following its aforementioned release due to the all-fire acceleration in the direction of the arrow 157 acting on the inertia of the striker mass 152. By properly designing the geometry of the shearing pin 131 and its neck 132 and selection of the proper material for the shearing pin 131, the shearing pin can be designed to fracture in shear (or in any other mode) during the all-fire event as was described for the embodiment 50 of FIG. 4, thereby releasing the striker mass 152 and allowing it to be accelerated in the clockwise rotation.

By selecting a proper mass and moment of inertial for the striker mass 152 and the required range of clockwise rotation for the striker mass 152, it would gain enough kinetic energy to initiate the pyrotechnic material 164 between the pinching points provided by the protrusions 165 and 166 on the base element 151 and the bottom surface of the striker mass 152, respectively. The ignition flame and sparks can then travel down through the opening 167 provided in the base element 151. When assembled in a thermal battery similar to the thermal battery 16 of FIG. 1, the inertial igniter is mounted in the housing 10 such that the opening 167, FIG. 9, is lined up with the opening 12 into the thermal battery 11 to activate the battery by igniting its heat pallets.

In the embodiment of FIG. 9, the sliding and spring elements of the locking ball release mechanism may be configured in numerous ways, e.g., the sliding element 158 may be replaced with a rotating member (which may reduce the possibility of jamming) and the spring member 161 may be combined with the rotating member, i.e., as a flexible beam element with the inertia of the beam acting as the mass element of the slider.

The sliding element may also be provided with a cup-like base under the ball (with the ball sticking out into the sliding element and over the lip of the cup) so that a top piece is not needed to prevent the preloaded spring to push the sliding element out (up) (see e.g., U.S. Pat. No. 8,550,001, issued Oct. 8, 2013, the contents of which is incorporated herein by reference.

It is also appreciated by those skilled in the art that the rotary hinge 153 and 53 of the embodiments 130 and 50 of FIGS. 9 and 4, respectively, used to attach the corresponding striker masses 152 and 52 to the base elements 151 and 52 of the inertial igniters do not have to be constructed with a pin passing through the connected rotating parts as shown in the said schematics. They may, for example, be constructed with a living joint. Alternatively, the joint may also be constructed with one side (for example the striker mass side) formed as a rolling surface with mating surfaces on the base element surface; or with an intermediate roller or balls with preloaded springs keeping them in contact; or other similar methods known in the art.

The above embodiments were described in terms of their application for activating thermal batteries, i.e., for providing flames and sparks generated by the ignition of pyrotechnic materials to thermal batteries for the purpose of activating the batteries through ignition of their pyrotechnic heat pallets. It will be, however, appreciated by those skilled in the art that the same inertial igniters can be used to activate other types of reserve batteries, such as liquid reserve batteries as are well known in the art for releasing their stored electrolyte from their storage compartment. The inertial igniters may also be used for directly initiating pyrotechnic trains or other type of energetic materials.

It will also be appreciated that the mechanisms of operation of the disclosed embodiments, i.e., the process of releasing the striker mass when the all-fire event is detected, may be used to fracture or rupture the electrolyte storage container (or capsule) of a liquid reserve battery, thereby releasing the electrolyte into the battery cell and causing it to be activated.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An inertial igniter for igniting a thermal battery upon a predetermined acceleration, the inertial igniter comprising:

a support structure including a base, the base having a first projection;

a striker mass having a second projection aligned with the first projection such that when the striker mass moves towards the base, the first projection impacts the second projection;

two or more links rotatably connected to the striker mass to movably support the striker mass between a first position away from the base and a second position in which the first projection strikes the second projection; and a spring for biasing the two or more links into the first position;

wherein the two or more links moves the striker mass towards the second position upon experiencing the predetermined acceleration against the biasing such that the first projection impacts the second projection.

2. The inertial igniter of claim 1, wherein the two or more links comprises a first link and a second link, the first and second links each being rotatably connected to the striker mass.

3. The inertial igniter of claim 2, wherein the spring biases one of the first and second links.

4. The inertial igniter of claim 3, wherein:

the first link has a first end rotatably connected to the support structure and a second end rotatably connected to the striker mass;

the second link has a first end rotatably connected to the striker mass and a second end movable within a cavity of the support structure; and the spring is disposed within the cavity to bias the second end of the second link such that the striker mass is biased into the first position.

5. The inertial igniter of claim 4, wherein an amount of the biasing is variable.

6. The inertial igniter of claim 4, wherein the second end of the second link is movable in translation within in a guide formed in the support structure.

7. The inertial igniter of claim 6, wherein the second end of the second link is constrained to move in a direction perpendicular to a direction in which the striker mass is movable.

8. The inertial igniter of claim 7, further comprising a sliding block rotatably connected to the second end of the second link, the sliding block being constrained to move within the guide in the direction perpendicular to the direction in which the striker mass is movable.

9. The inertial igniter of claim 1, further comprising a stop for limiting a movement of the striker mass away from the base.

10. The inertial igniter of claim 9, wherein a position of the stop relative to the base is variable.

11. The inertial igniter of claim 1, further comprising a pyrotechnic material covering the second projection.

12. The inertial igniter of claim 11, wherein the base further comprising a hole adjacent the second projection and covered by the pyrotechnic material.

* * * * *